US007334786B2

(12) United States Patent
Shinga

(10) Patent No.: US 7,334,786 B2
(45) Date of Patent: Feb. 26, 2008

(54) SHEET FEEDING APPARATUS AND IMAGE FORMING APPARATUS

(75) Inventor: Takahiro Shinga, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 504 days.

(21) Appl. No.: 11/079,118

(22) Filed: Mar. 15, 2005

(65) Prior Publication Data

US 2005/0201765 A1 Sep. 15, 2005

(30) Foreign Application Priority Data

Mar. 15, 2004 (JP) ..... 2004-072998
Nov. 5, 2004 (JP) ..... 2004-322715

(51) Int. Cl.
*B65H 3/44* (2006.01)

(52) U.S. Cl. ..... 271/9.11; 271/256; 271/258.01; 271/145; 271/162

(58) Field of Classification Search ..... 271/9.11, 271/9.12, 9.13, 258.01, 256, 257, 273, 145, 271/162, 164, 264
See application file for complete search history.

(56) References Cited

U.S. PATENT DOCUMENTS 5,413,409 A * 5/1995 Arai ..... 312/330.1
5,765,825 A * 6/1998 Watase ..... 271/9.13
5,765,826 A * 6/1998 Isoda et al. ..... 271/162
6,523,821 B2 * 2/2003 Kashiwagi et al. ..... 271/145
7,168,701 B2 * 1/2007 Isaka et al. ..... 271/273
2005/0067773 A1 * 3/2005 Yoshida et al. ..... 271/264

FOREIGN PATENT DOCUMENTS

JP 6-183579 7/1994
JP 7-110711 11/1995

* cited by examiner

*Primary Examiner*—David H Bollinger
(74) *Attorney, Agent, or Firm*—Oblon, Spivak, McClelland, Maier & Neustadt, P.C.

(57) ABSTRACT

A sheet feeding apparatus includes a sheet feeding tray, a lock mechanism that locks the sheet feeding tray, a sheet feeding unit that feeds sheets from the sheet feeding tray one by one, an opening and closing unit that opens and closes a conveyance path, a sheet detecting sensor that detects presence of a sheet at a position at which the opening and closing unit is arranged, and a state detecting unit that detects a state of the opening and closing unit. When the sheet detecting sensor detects that a sheet is stuck during conveyance of the sheet, the lock mechanism locks the sheet feeding tray not to be drawn out, and unlock the sheet feeding tray after the opening and closing unit opens the conveyance path.

9 Claims, 13 Drawing Sheets

SHEET FEEDING APPARATUS AND IMAGE FORMING APPARATUS

CROSS-REFERENCE TO RELATED APPLICATIONS

The present document incorporates by reference the entire contents of Japanese priority documents, 2004-072998 filed in Japan on Mar. 15, 2004 and 2004-322715 filed in Japan on Nov. 5, 2004.

BACKGROUND OF THE INVENTION

1) Field of the Invention

The present invention relates to a sheet feeding apparatus that supplies sheets to an image forming apparatus and an image forming apparatus that includes the sheet feeding apparatus.

2) Description of the Related Art

Some of image forming apparatuses, which include a sheet feeding apparatus that feeds sheets one by one from a sheet feeding tray, are front loading machines in which the sheet feeding tray is arranged in such a manner that a direction to which the sheets are conveyed and a direction to which the sheet feeding tray is drawn out are substantially orthogonal. In most of such image forming apparatuses, when a jam occurs, a guide plate in a conveying direction is opened to remove a jammed sheet. Such a technology is disclosed in, for example, Japanese Patent Application Laid-open No. H6-183579.

However, actually, a user often draws out the sheet feeding tray without performing such a process to deal with the jam. In this case, the jammed sheet is torn while remaining astride the sheet feeding tray and the sheet feeding apparatus. As a result, serious damages can be caused, for example, leaving a piece of the jammed sheet torn inside the sheet feeding apparatus.

In addition, in a conventional technology, the image forming apparatuses includes an arrangement in which separating members, such as a separating roller and a friction pad, are automatically separated from a sheet when a jam occurs. Moreover, in another conventional technology, the image forming apparatus includes an arrangement in which separating members are separated from a sheet in association with attachment and detachment of a sheet feeding tray for a purpose of reducing a manufacturing cost. Both arrangements in the conventional technologies are for drawing out the sheet feeding tray smoothly by eliminating a load on the jammed sheet when a user draws out the sheet feeding tray.

However, in actual fact, there are various patterns of jams. The various patterns of jams include jams in which almost an entire sheet remains in the sheet feeding tray, in which, conversely, most of a sheet has entered the sheet feeding apparatus, and in which a sheet is buckled inside the sheet feeding apparatus.

In any of the patterns of jams, when the sheet feeding tray is drawn out suddenly, the damages described above are often caused, and is one of major factor of requirement of service maintenance.

SUMMARY OF THE INVENTION

It is an object of the present invention to solve at least the above problems in the conventional technology.

A sheet feeding apparatus according to one aspect of the present invention includes a sheet feeding tray that houses sheets; a sheet feeding device that feeds the sheets from the sheet feeding tray one by one; a lock mechanism that locks the sheet feeding tray to prevent draw-out of the sheet feeding tray; an opening and closing unit that is pivotable in an open state and a close state, and that forms a conveyance path of the sheet when in the close state; a sheet detecting unit that detects whether a sheet is present in the conveyance path; a state detecting unit that detects whether the opening and closing unit is in the open state or the close state; and a control unit that, when the sheet detecting unit detects a sheet in the conveyance path, controls the lock mechanism to lock the sheet feeding tray, and when the state detecting unit detects that the opening and closing unit is in the open state, controls the lock mechanism to unlock the sheet feeding tray.

An image forming apparatus according to another aspect of the present invention includes a sheet feeding apparatus according to the above aspect.

The other objects, features, and advantages of the present invention are specifically set forth in or will become apparent from the following detailed description of the invention when read in conjunction with the accompanying drawings.

DETAILED DESCRIPTION

Exemplary embodiments of the present invention will be hereinafter explained in detail with reference to the accompanying drawings.

Figure 1:
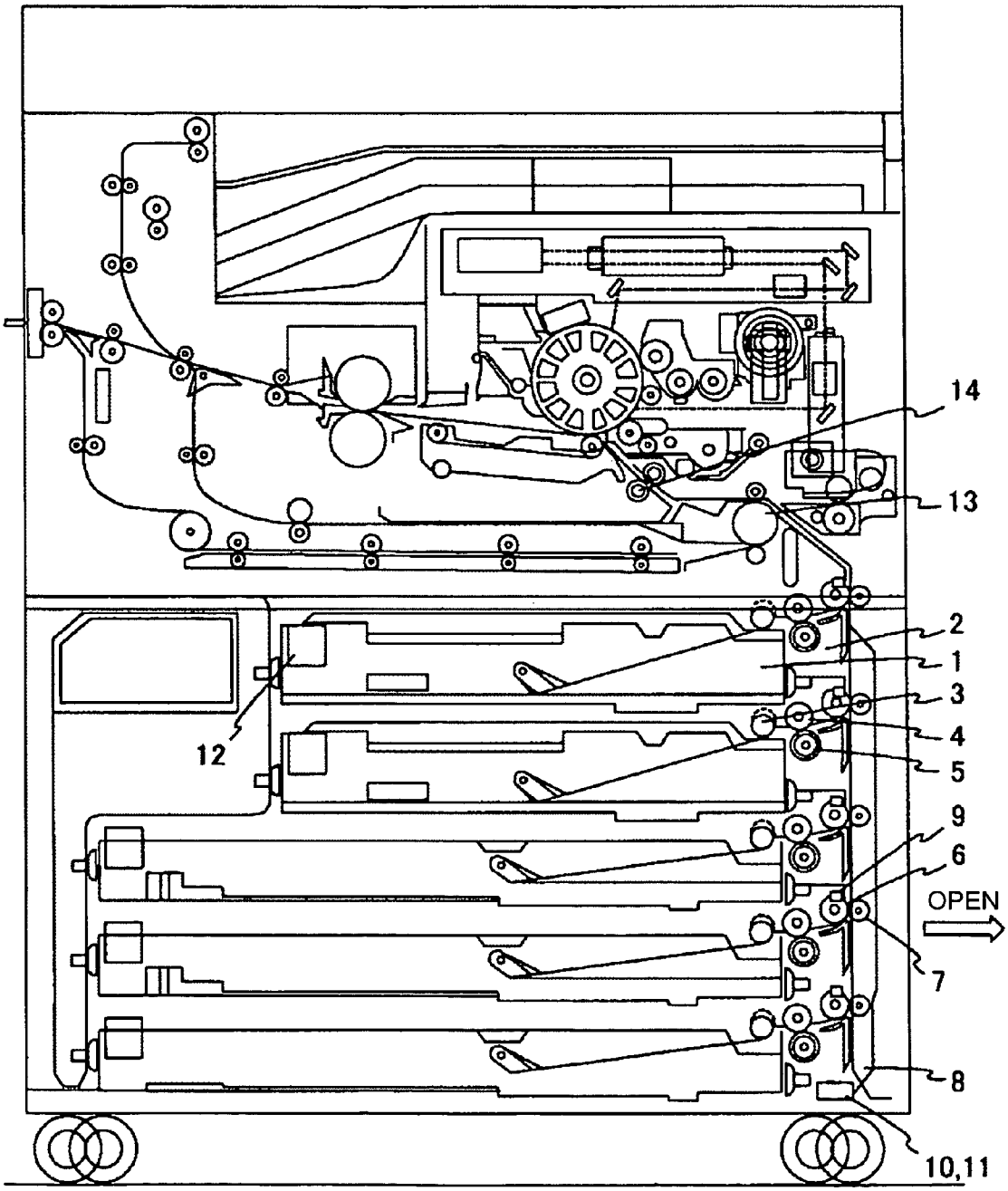
FIG. 1 is a schematic diagram of an image forming apparatus according to an embodiment of the present invention.

FIG. 1 is a schematic diagram of an image forming apparatus. As shown in FIG. 1, sheet feeding trays 1 are provided in multiple stages (five stages in the figure). The sheet feeding trays 1 are drawn out to a front side in the figure when sheets are supplied therein. The sheets are stored in a pile in each of the sheet feeding trays 1.

A sheet feeding unit 2 is provided at an end of each of the sheet feeding trays 1 and comes into contact with a sheet on top of the pile of the sheets in the sheet feeding tray 1 to send out and feed the sheets one by one. The sheet feeding unit 2 feeds the sheets at predetermined timing.

The sheet feeding unit 2 has a structure in which the sheets are separated and conveyed with a pickup roller (a sheet feeding device) 3 that picks up the sheets stacked in the sheet feeding tray 1, a sheet feeding roller 4 that conveys the sheets picked up, and a separating roller 5 that separates overlapped sheets and delivers the sheets upwards with vertical conveyance rollers 6 that is provided at a position that is downstream to the sheet feeding unit 2 in a direction to which the sheets are conveyed.

Driven side rollers 7 of the vertical conveyance rollers 6 are provided in a vertical conveyance guide plate 8, which is arranged astride all the sheet feeding stages, and adapted to grip a fed sheet. The vertical conveyance guide plate (opening and closing unit) 8 is pivotally moved toward a direction shown with an arrow around an inner fulcrum such that the sheet feeding unit is opened and a sheet jammed in the sheet feeding unit can be pulled out.

In each of the sheet feeding units 2, a sheet detecting sensor (a reflective photo-sensor) 9 that detects presence of a sheet, is provided at a position that is close to and downstream to nip portions of the vertical conveyance rollers 6 in a direction to which the sheets are conveyed. This makes it possible to judge, while a sheet is passed, whether a result of the detection of a sheet is normal or abnormal at any time from a calculation value, which can be calculated from a sheet size and sheet conveying speed. When the result is abnormal, it is judged whether the sheet remains in the sheet feeding unit 2 or the sheet has not reached the sheet feeding unit 2.

An open and close detecting unit (a micro-switch) 10 and an opening and closing angle detecting unit (a reflective photo-sensor, i.e., an opening and closing angle sensor) 11 are provided below the vertical conveyance guide plate 8 such that it is possible to grasp a state of the vertical conveyance guide plate 8 whether it is opened or closed.

A tray lock mechanism 12 (described later) for preventing the sheet feeding trays 1 to be drown out is provided in the sheet feeding tray 1 at an end that is on an opposite side to the side at which the sheet feeding unit 2 is provided. The tray lock mechanism locks and unlocks the sheet feeding tray 1 depending on a state of a jam.

The sheet delivered by the vertical conveyance rollers 6 is conveyed to a transfer unit, a fixing unit, a sheet discharge unit, a double-sided unit, and the like via an intermediate roller 13 and a registration roller 14. However, since processes after the sheet is delivered by the vertical conveyance rollers 6 are the same as those in the usual copying machine, explanations of the processes will be omitted.

Figure 2:
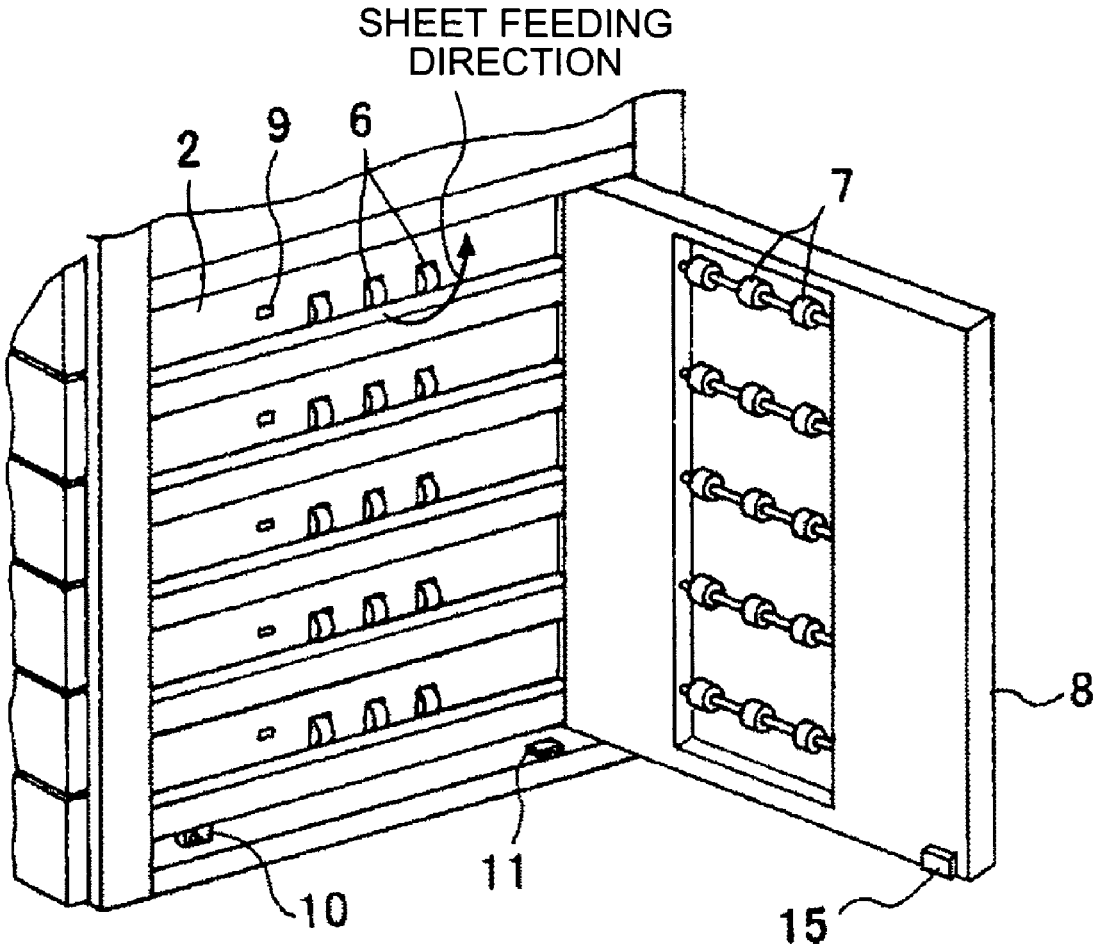
FIG. 2 is a perspective diagram of a vertical conveyance guide plate shown in FIG. 1.

FIG. 2 a schematic diagram of a vertical conveyance guide plate 8 shown in FIG. 1 when the vertical conveyance guide plate 8 is opened. As described above, the vertical conveyance guide plate 8 is opened and closed around an inner fulcrum 8*a* and includes the driven side rollers 7 and the sheet feeding unit 2 in predetermined positions. This sheet feeding unit 2 includes the vertical conveyance rollers 6 and the sheet detecting unit (the sheet detecting sensor) 9.

An arrow shown in FIG. 2 indicates a discharge position of a sheet (a sheet feeding direction), which is identical in the respective sheet feeding stages. The open and close detecting unit (a micro-switch) 10 is provided on a base surface and is turned ON and OFF by a pawl 15 provided at a lower part of the vertical conveyance guide plate 8 to thereby detect an opening and closing state of the vertical conveyance guide plate 8. The opening and closing angle detecting unit (the reflective photo-sensor) 11 is provided to face upward near the opening and closing fulcrum. The opening and closing angle detecting unit 11 reflects emitted light from a light-emitting element to a suitable place of the vertical conveyance guide plate 8 and, then, detects the light with a light-receiving element to thereby detect an opening angle of the vertical conveyance guide plate 8.

Figure 3:
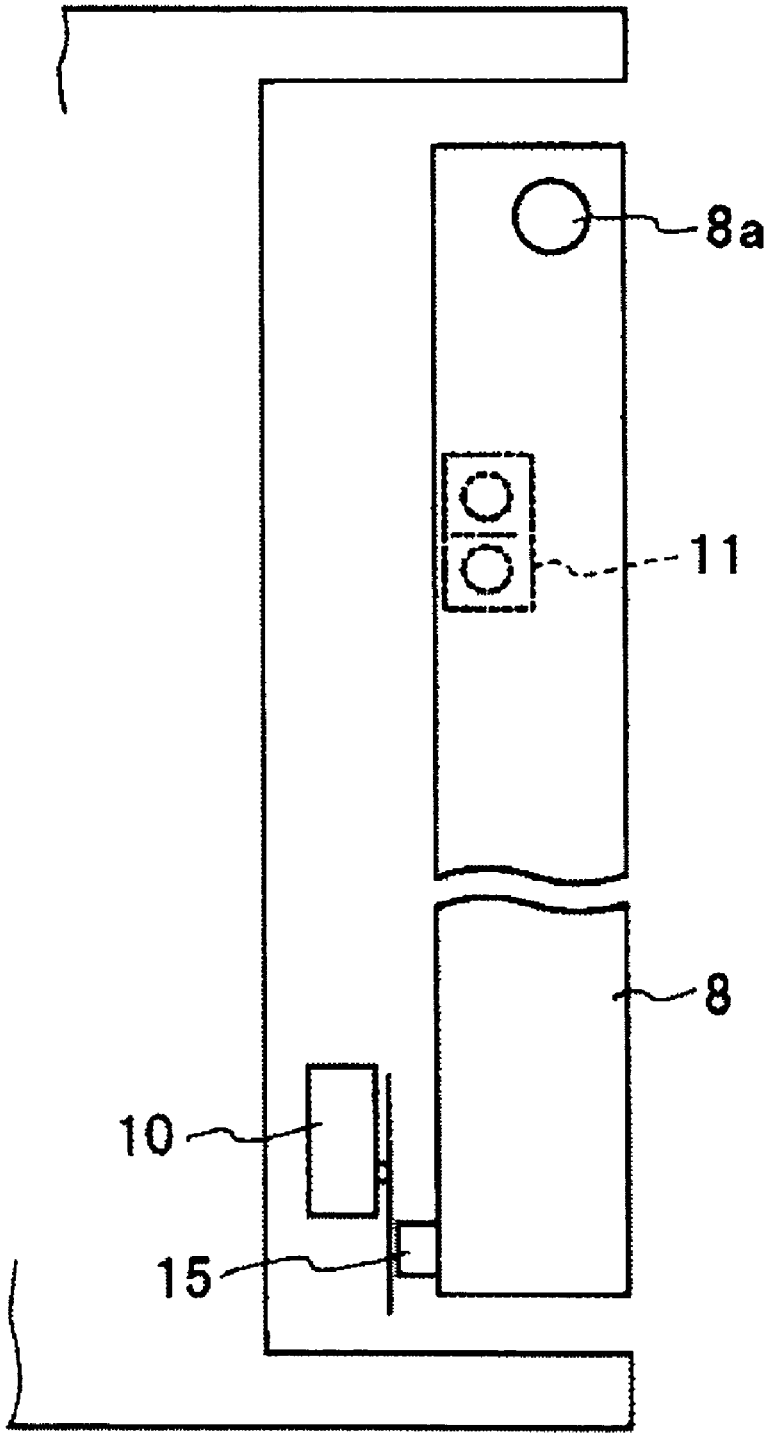
FIG. 3 is a plan view of the vertical conveyance guide plate when the vertical conveyance guide plate is closed.

FIG. 3 is a plan view of the vertical conveyance guide plate 8 for explaining a state in which a position of the vertical conveyance guide plate is detected. The vertical conveyance guide plate 8 shown in FIG. 3 is in a closed state in which the vertical conveyance guide plate 8 is closed from an open state. The vertical conveyance pawl 15 pushes in a lever of the open and close detecting unit (the micro-switch) 10.

Figure 4:
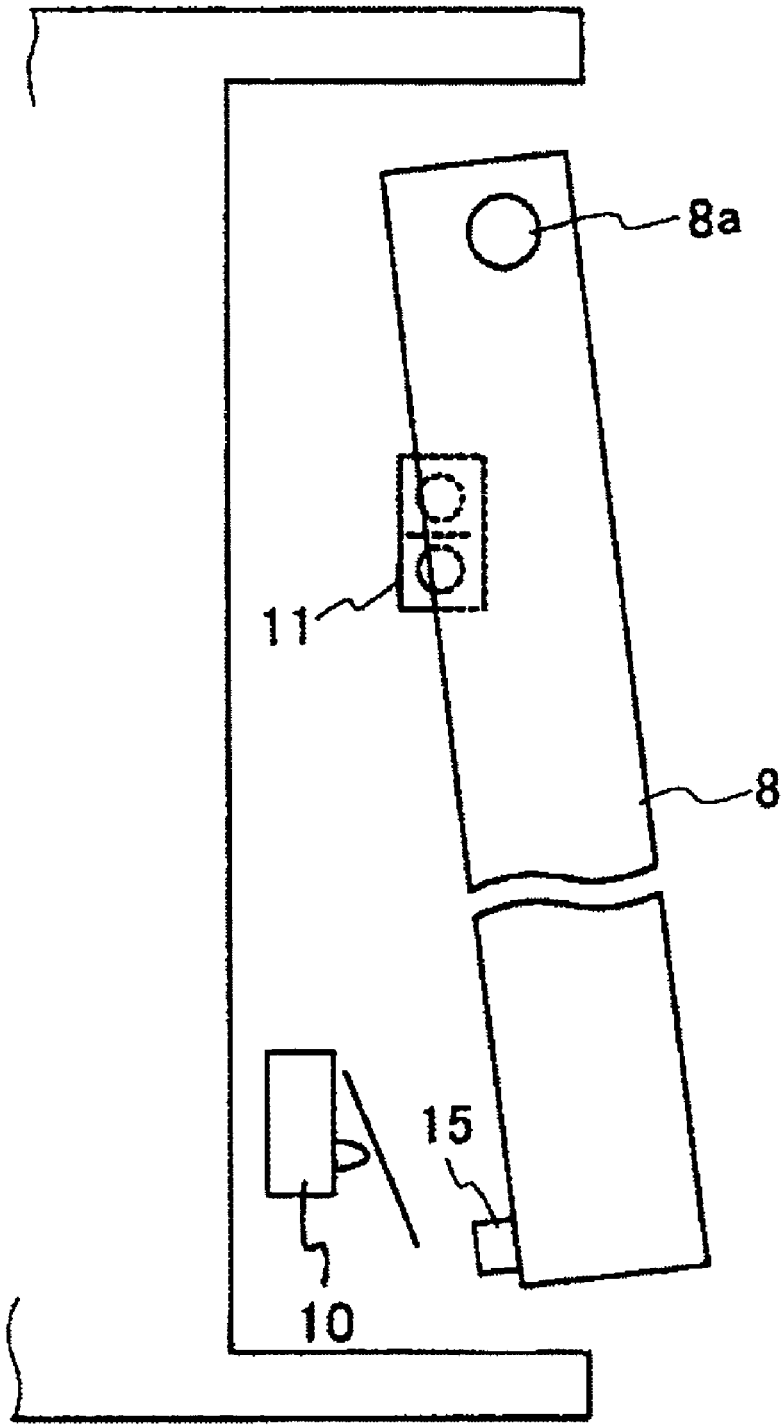
FIG. 4 is a plan view of the vertical conveyance guide plate when the vertical conveyance guide plate is partially open.

FIG. 4 is a plan view of the vertical conveyance guide plate at an early stage of opening the vertical conveyance guide plate 8. In the state shown in FIG. 4, the opening and closing angle detecting unit 11 still detects the vertical conveyance guide plate 8, meaning that the vertical conveyance guide plate is still not sufficiently opened for performing a jam treatment.

Figure 5:
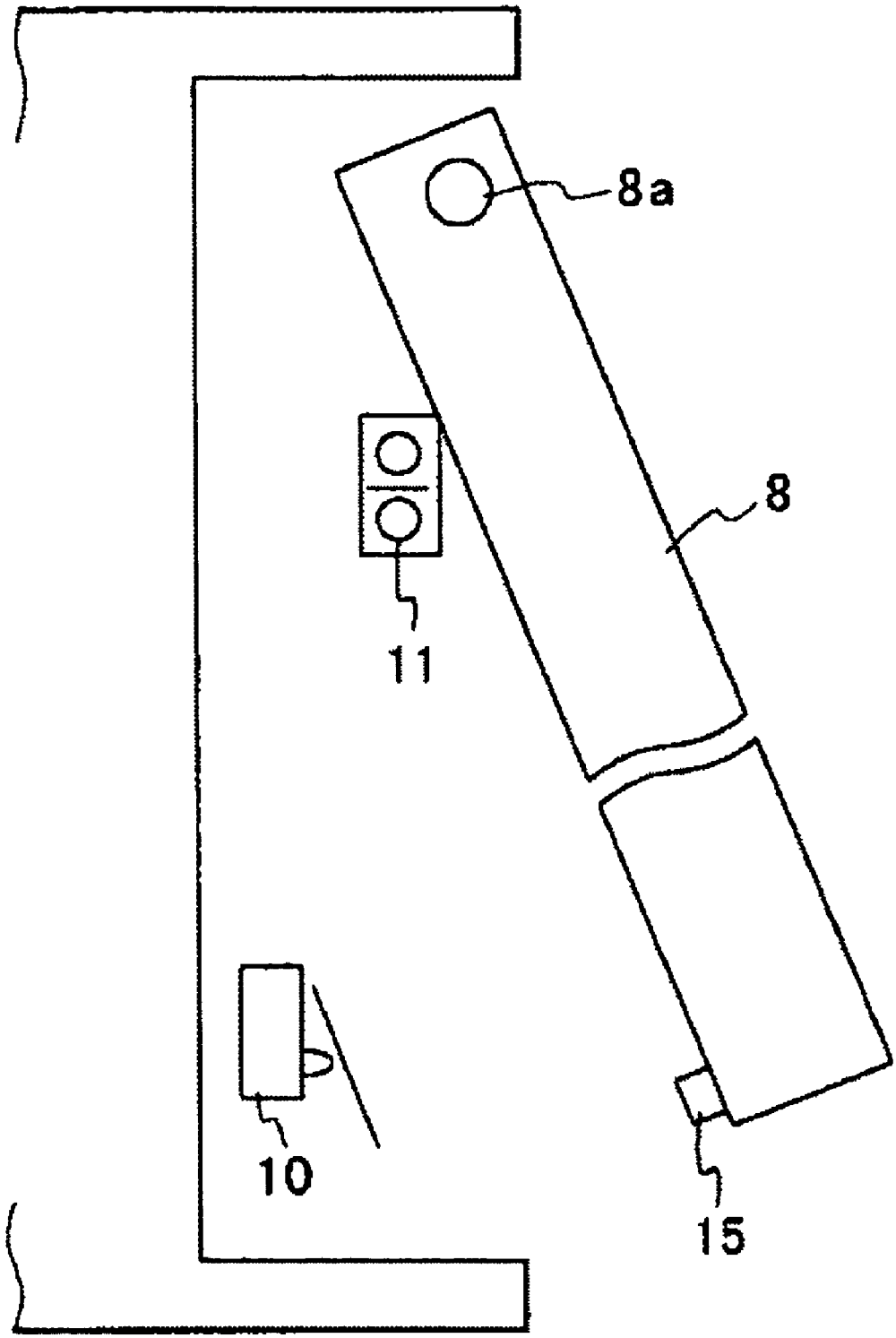
FIG. 5 is a plan view of the vertical conveyance guide pate when the vertical conveyance guide plate is fully open.

FIG. 5 is a plan view of the vertical conveyance guide plate 8 when the vertical conveyance guide plate 8 is fully opened. Both the open and close detecting unit 10 and the opening and closing angle detecting sensor 11 do not detect the vertical conveyance guide plate 8. It is recognized that a sufficient space that allows a user to perform the jam treatment from a vertical conveyance side is secured.

Figure 6:
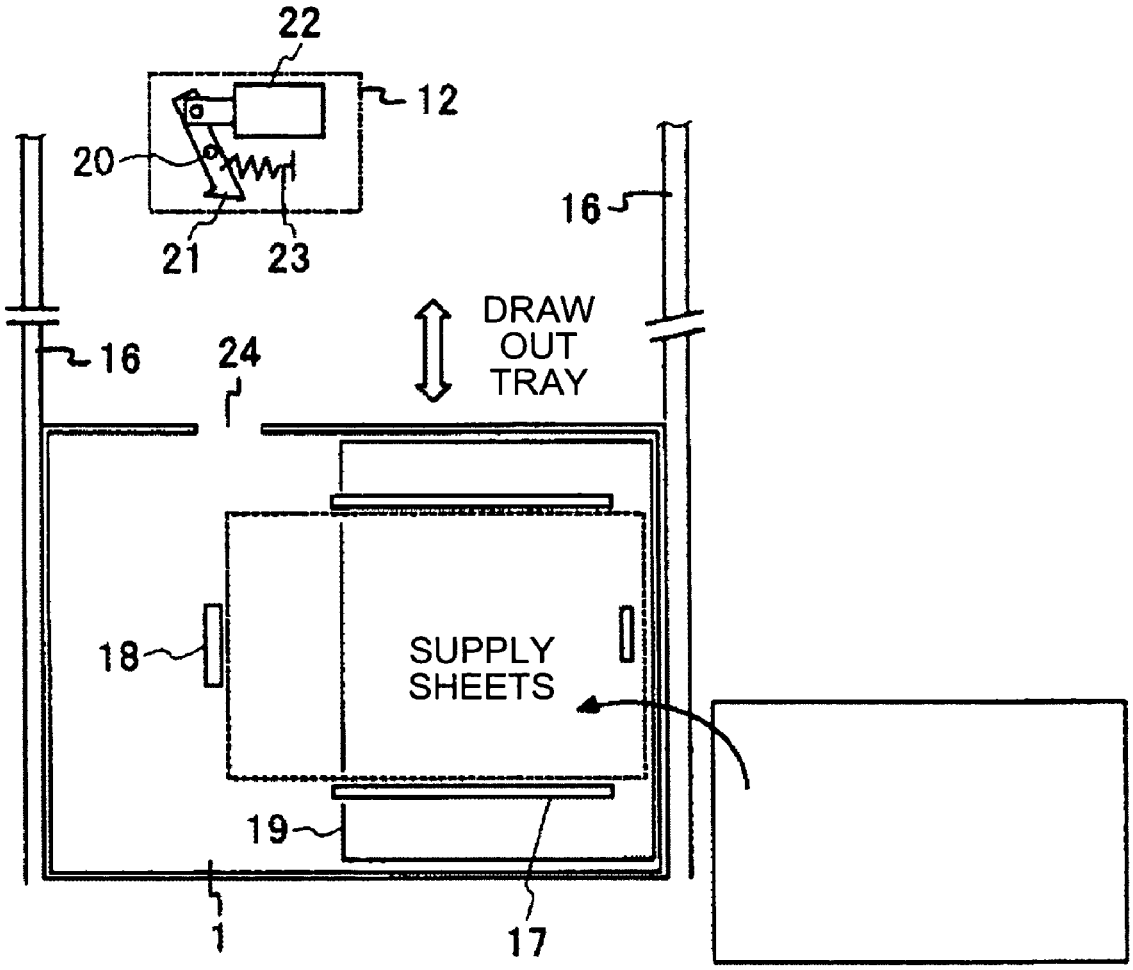
FIG. 6 is a schematic diagram of a tray lock mechanism of a sheet feeding tray shown in FIG. 1.

FIG. 6 is a schematic diagram of the tray lock mechanism 12 provided in the sheet feeding tray 1. As shown in FIG. 6, a slide rail pair 16 extending in a front-to-rear direction of the sheet feeding tray 1 is attached on both sides of the sheet feeding tray 1 such that it is possible to draw out the sheet feeding tray 1 to the front of the image forming apparatus and supply sheets therein as described above.

Figure 7:
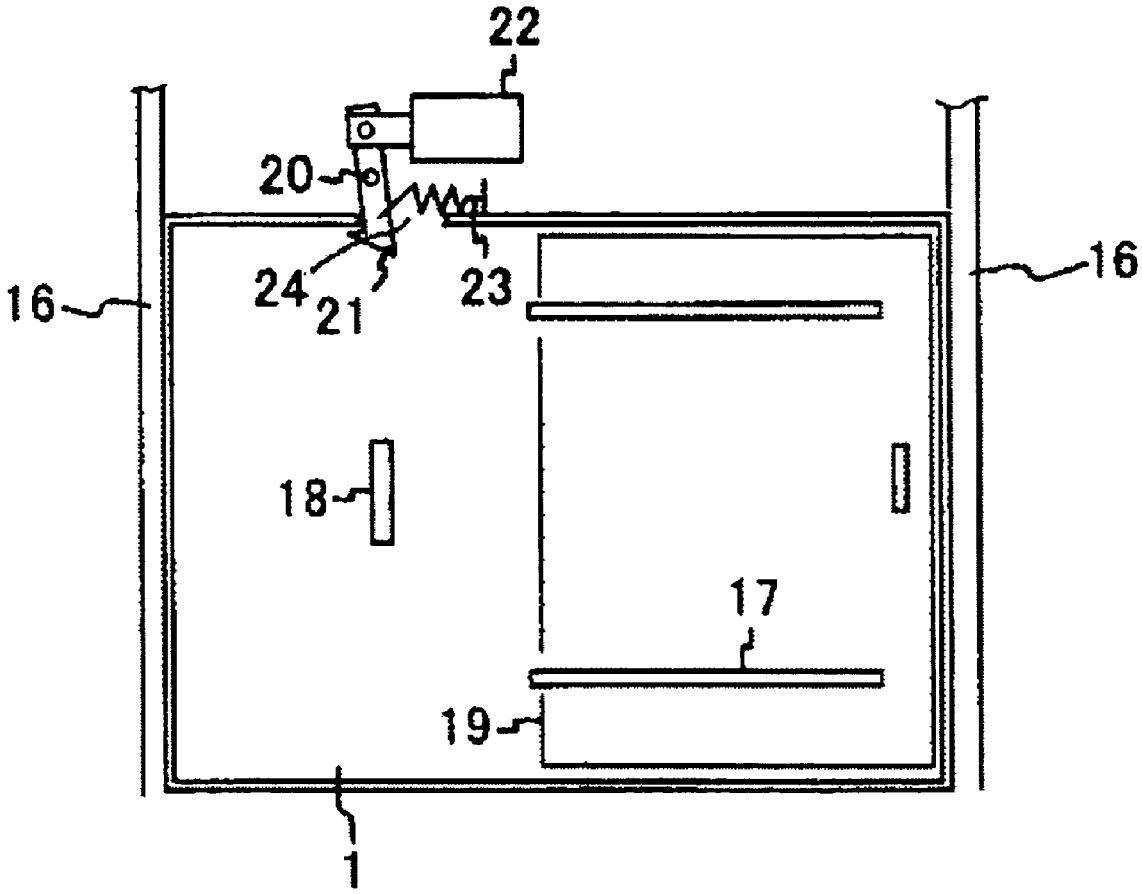
FIG. 7 is a schematic diagram of a side fence pair and an end fence pair shown in FIG. 6.

FIG. 7 is a schematic diagram of a side fence pair and an end fence pair provided in the sheet feeding tray 1. As shown in FIG. 7, the sheet feeding tray 1 includes a side fence pair 17, an end fence 18, and a bottom plate 19.

The tray lock mechanism 12 fixed on a side of the main body includes a lock pawl 21 supported by a rotation fulcrum 20, a lock solenoid 22 that draws in the lock pawl 21, and a release spring 23 that pulls the lock pawl 21 in a releasing direction when the lock solenoid 22 is OFF.

A square hole 24, in which the lock pawl 21 fits, is provided in an inner wall of the sheet feeding tray 1. In the state shown in FIG. 6, since the lock solenoid 22 is OFF and the lock pawl 21 is fixed in a released position by the release spring 23 and does not fit in the square hole 24, draw-out of the sheet feeding tray 11 is not restricted.

When a jam occurs and the sheet feeding tray 1 cannot be drawn out, as shown in FIG. 7, the lock solenoid 22 is turned ON and draws in the lock pawl 21, whereby a tip of the lock pawl 21 fits in an inner periphery of the square hole 24 of the sheet feeding tray 1 and the sheet feeding tray 1 cannot be drawn out.

Figure 8:
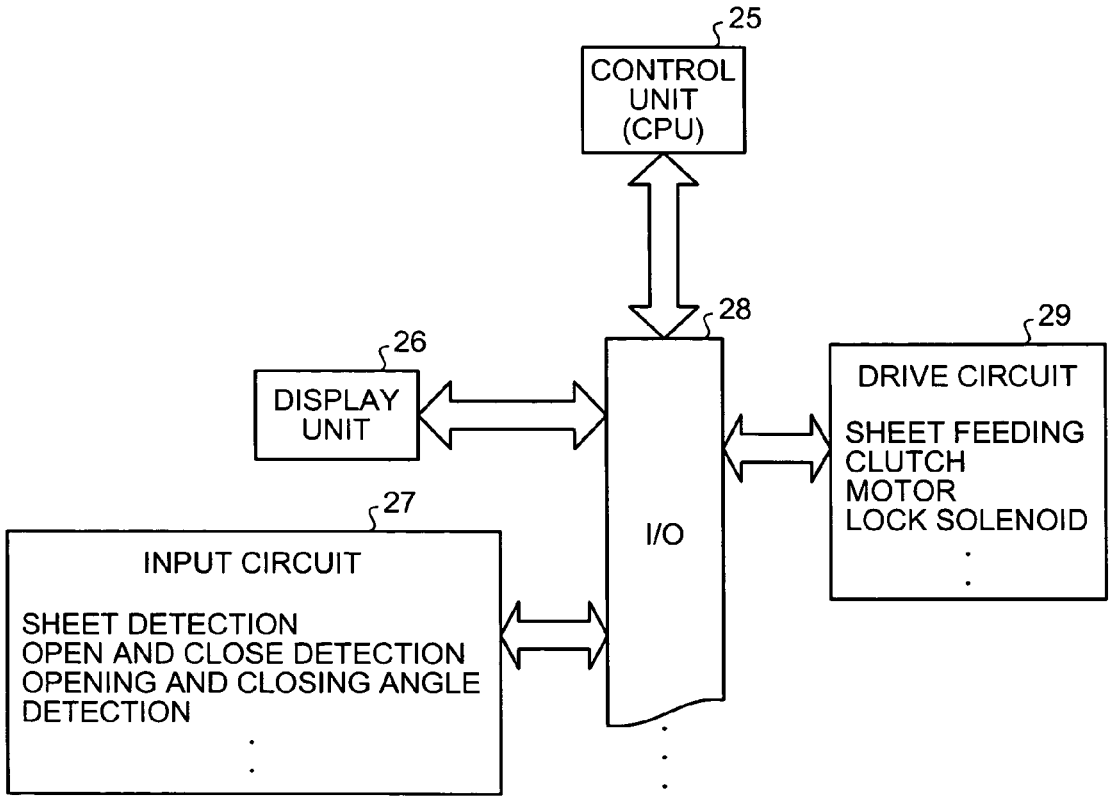
FIG. 8 is a block diagram of an electric circuit in the main body of the image forming apparatus.

FIG. 8 is a block diagram of an electric circuit of the main body of the image forming apparatus. In the electric circuit, a control unit (CPU) 25, a display unit 26 that displays that a jam is occurred and informs a user of the occurrence, an input circuit unit 27 (which detects signals of a sheet detecting sensor 9, an open and close detecting unit 10, and an opening and closing angle detecting sensor 11), and a drive circuit unit 29 that controls ON/OFF of a sheet feeding clutch, a sheet feeding motor, the lock solenoid 22, and the like are connected to one another via an I/O interface 28.

Figure 9:
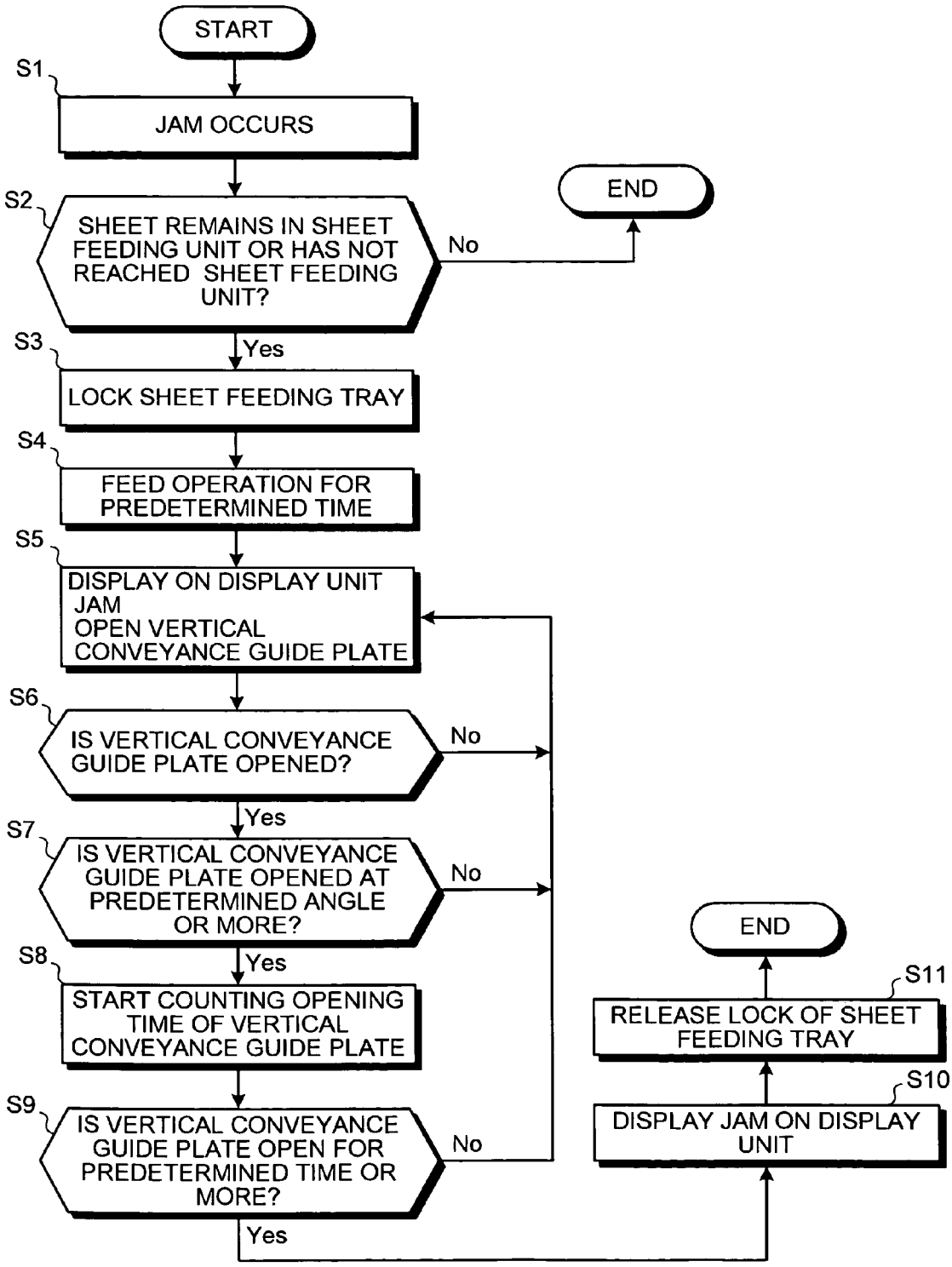
FIG. 9 is a flowchart of a control of a sheet feeding apparatus according to the present invention.

FIG. 9 is a flowchart of a control of a sheet feeding apparatus according to the present invention. When a jam occurs (step S1), the sheet detecting sensor 9 judges whether the jam is caused by a sheet that is stuck in the sheet feeding unit 2 or a sheet that has not reached the sheet feeding unit 2 (step S2). If the jam is occurred in a different place, this control ends.

Figure 10:
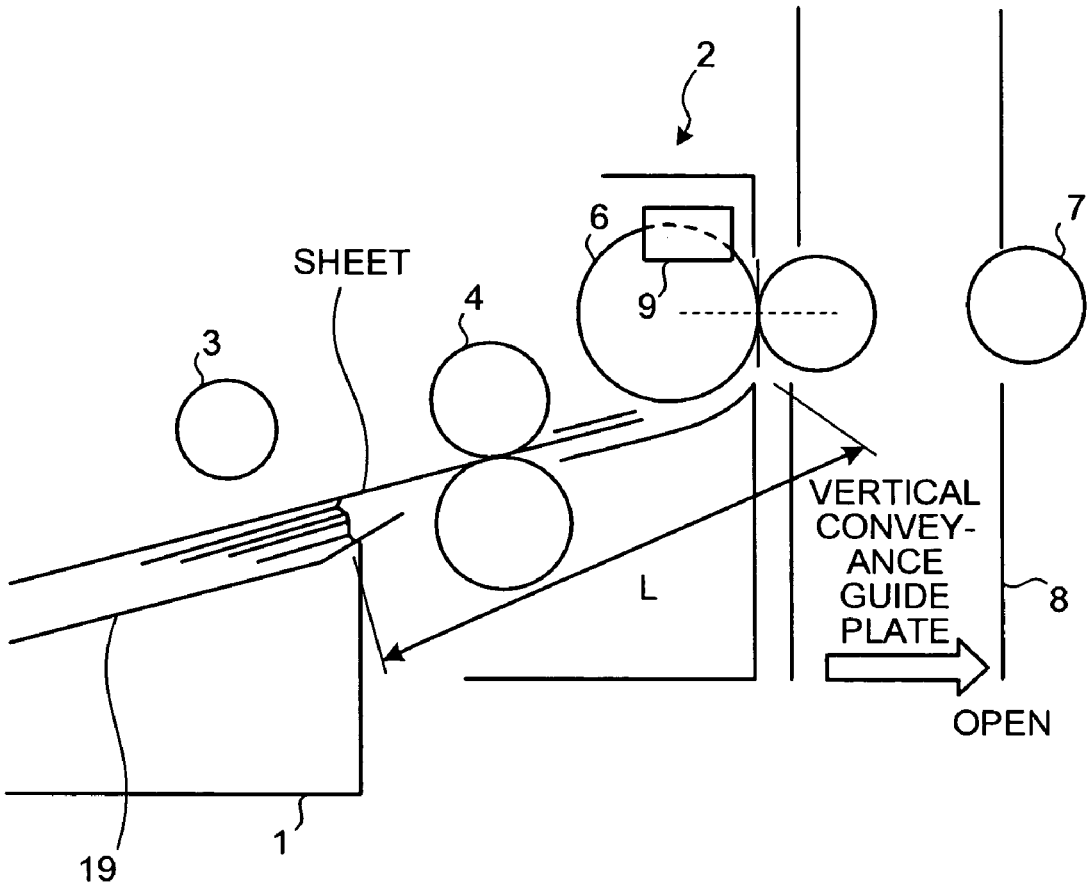
FIG. 10 is a schematic diagram of a sheet feeding unit for explaining a state in which a sheet inside the sheet feeding unit is sent out.
Figure 11:
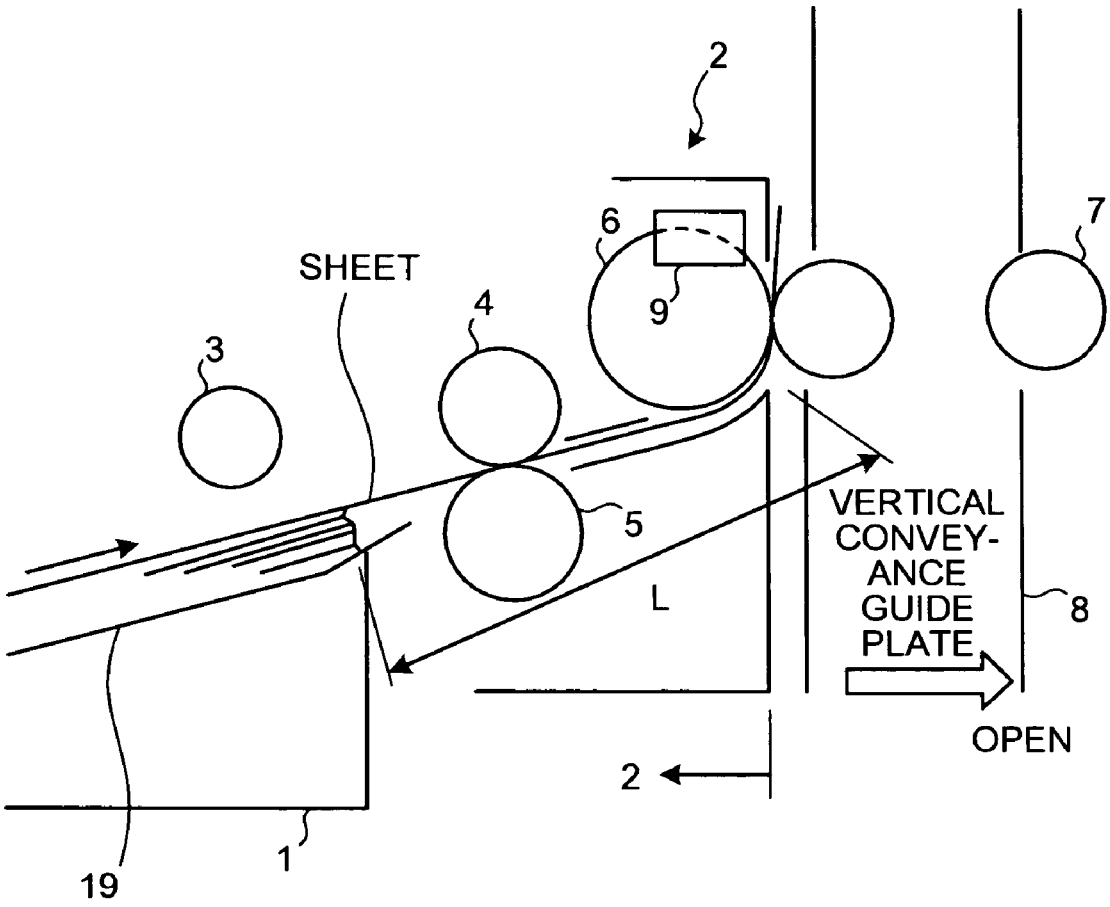
FIG. 11 is a schematic diagram of the sheet feeding unit for explaining the state in which a sheet inside the sheet feeding unit is sent out when the sheet is in a different position.

When the jam is occurred in the place mentioned above, the feet feeding apparatus locks the sheet feeding tray 1 with the tray lock mechanism 12 such that a user cannot draw out the sheet feeding tray 1 (step S3). In this case, the sheet feeding apparatus locks the sheet feeding tray 1 of a stage from which the sheet is fed. The sheet feeding apparatus drives the sheet feeding tray 1 of the sheet feeding unit 2 for a predetermined time. The sheet feeding apparatus drives the sheet feeding tray 1 from which the sheet is fed. With this operation, the sheet feeding apparatus discharges a sheet remaining astride the sheet feeding tray 1 and the sheet feeding unit 2 to the side of the vertical conveyance guide plate 8 such that there is no sheet remaining on the side of the sheet feeding unit 2 at the time of the jam treatment (step S4) (details are shown in FIGS. 10 and 11).

Next, the sheet feeding apparatus displays about the jam of the sheet and an instruction for opening the vertical conveyance guide plate 8 on the display unit 26 to urge the user to remove the jammed sheet from the side of the vertical conveyance guide plate 8 (step S5). The sheet feeding apparatus judges the state of the vertical conveyance guide plate 8 with the open and close detecting unit 10 (step S6).

If the vertical conveyance guide plate 8 is not opened, the sheet feeding apparatus returns to step S5 and repeats the processing. If the vertical conveyance guide plate 8 is opened ("YES" at step S6), the sheet feeding apparatus judges the state of the vertical conveyance guide plate 8 with the opening and closing angle detecting sensor 11 (step S7). If the vertical conveyance guide plate 8 is not opened to a predetermined angle, the sheet feeding apparatus returns to step S5 and repeats the processing. If the vertical conveyance guide plate 8 is opened to the predetermined angle, the sheet feeding apparatus counts an elapsed time with the control unit 25 from a point in time when it is detected that the vertical conveyance guide plate 8 is opened, setting the point as "0" (step S8).

Subsequently, the sheet feeding apparatus judges whether the elapsed time (a time during which the vertical conveyance guide plate 8 is open at the predetermined angle or more) has reached a predetermined time (step S9). If the predetermined time has not elapsed, the sheet feeding apparatus returns to step S5 and repeats the processing. If the predetermined time has elapsed, the sheet feeding apparatus judges that the vertical conveyance guide plate 8 has been sufficiently opened to perform the jam treatment and that the jam treatment has been started, turns off a display of "open the vertical conveyance guide plate 8", and displays only about the jam (step S10). Finally, the sheet feeding apparatus releases the tray lock of the sheet feeding-tray 1 (step S11).

The opening angle refers to an angle of opening of the vertical conveyance guide plate 8 that is considered to be sufficient for the user to visually recognize an entire vertical conveyance path, which indicates a path through which a sheet is conveyed in a sheet feeding direction from the inside of the sheet feeding unit, without a blind spot in the vertical conveyance guide plate 8. For example, the opening angle is set to 45 degrees in the image forming apparatus according to this embodiment. Note that the predetermined angle is not limited to 45 degrees and varies depending on a size of an apparatus like an image forming apparatus in which the sheet feeding apparatus of the invention is used.

In addition, the opening time is defined as a minimum time that is required by the user for opening the vertical conveyance guide plate 8 and visually recognizing the entire vertical conveyance path without a blind spot. For example, the opening time is set to five seconds in the image forming apparatus according to this embodiment. Note that the predetermined time is not limited to five seconds. The predetermined time varies depending on a size of an apparatus like the image forming apparatus in which the sheet feeding apparatus of the invention is used, an opening and closing system of the vertical conveyance guide plate 8, and the like. Thus, it is necessary to set an appropriate time according to an apparatus.

FIG. 10 is a schematic diagram of a sheet feeding unit 2 for explaining a state in which a sheet inside the sheet feeding unit 2 is sent out. FIG. 11 is a schematic diagram of the sheet feeding unit 2 in which a sheet inside the sheet feeding unit 2 is sent out when the sheet is in a different position.

In FIG. 10, when a leading end of a sheet has not come out of the sheet feeding unit 2 at the time of occurrence of a jam, for example, when the sheet has not reached the sheet feeding unit 2 because the sheet feeding roller 4 slips by some chance or when the sheet being fed stops in the sheet feeding unit 2 because a preceding sheet is jammed in another place, presence or absence of the sheet cannot be confirmed in a state in which the vertical conveyance guide plate 8 is opened.

Thus, if a sheet feeding tray is drawn out after the jam treatment is finished in this state, it is likely that the sheet remaining astride the sheet feeding tray and the sheet feeding unit 2 is torn between the sheet feeding tray and the sheet feeding unit 2 resulting in causing damages.

Therefore, as shown in FIG. 11, the sheet feeding unit 2 is driven to perform control for forwarding and conveying a sheet with rollers for a predetermined time t before occurrence of a jam is displayed. When conveying speed is defined as v with respect to a distance L from position at which a sheet is stacked on the sheet feeding tray to a position at which a leading end of the sheet projects from the sheet feeding unit 2, the predetermined time t should at least be set to satisfy $t>L/v$.

The predetermined time t is set larger than L/v to provide a sufficient time for the sheet, which remains in the sheet feeding unit 2 or has not reached the sheet feeding unit 2, to reach the outside of the sheet feeding unit 2. By driving the sheet feeding unit 2 for this predetermined time t, it is theoretically possible to convey the sheet to the outside of the sheet feeding unit 2 even if a leading end of the sheet is present in any position on a path L inside the sheet feeding unit 2. In other words, by applying the sheet feeding operation to the sheet, which remains in the sheet feeding unit 2 or has not reached the sheet feeding unit 2, for the predetermined time t, it is possible to project the leading end of the sheet to the outside of the sheet feeding unit 2.

By applying this control to the sheet, the leading end of the sheet comes out of the sheet feeding unit 2. Thus, when the vertical conveyance guide plate 8 is opened, the user can notice the sheet hidden inside the sheet feeding unit 2 and remove the sheet.

The sheet feeding apparatus confirms whether a leading end of the jammed sheet has come out of the sheet feeding apparatus after performing this sheet feeding operation. The sheet detecting sensor 9 is used for this confirmation. This sheet detecting sensor 9 is assumed to be the same as the sheet detecting sensor 9 that performs judgment at step S10 shown in FIG. 9. As shown in FIG. 10, the sheet detecting sensor 9 is provided above a portion in which the vertical conveying roller 6 and the driven side rollers 7 are in contact with each other. The sheet detecting sensor 9 can detect whether the sheet is outputted from the inside of the sheet feeding unit 2 via the vertical conveying rollers 6 and the driven side rollers 7.

According to the invention, the opening and closing angle detecting unit is provided and the opening and closing angle detecting unit detects an opening and closing angle of the opening and closing unit. When the opening and closing unit is not open at an angle equal to or larger than a predetermined angle, the control unit determines that a sufficient space for performing a treatment for a jammed sheet is not provided, and judges that a necessary treatment is not sufficiently performed. Therefore, the control unit does not control to release the tray lock. Thus, it is possible to urge a user to perform the treatment for the jammed sheet surely.

As described above, when a leading end of a sheet has not come out of the sheet feeding apparatus at the time of occurrence of a jam, for example, when the sheet has not reached the sheet feeding device because the sheet feeding roller slips by some chance or when the sheet being fed stops in the sheet feeding device because a preceding sheet is jammed in another place, it is likely that the sheet is overlooked.

In this case, a corresponding sheet feeding unit is driven for a fixed time or at least a time allowing the sheet feeding unit to convey the sheet from a position in which the sheet is stacked in the sheet feeding tray to a position that is downstream in the sheet feeding apparatus. This makes it possible to, even in the case described above, project the tip of the sheet to the outside of the sheet feeding unit and prevent the user from overlooking the sheet at the time of the jam treatment.

In other words, when a jam occurs, even if a sheet remains in the sheet feeding unit or has not reached the sheet feeding unit, the control unit drives the sheet feeding unit to project a tip of the sheet to the outside of the sheet feeding unit. Consequently, when the user opens the vertical conveyance guide plate 8, since the sheet has been conveyed to a position where it is possible to prevent the user from overlooking the sheet, the user can visually recognize the tip of the sheet. In addition, since the sheet has been conveyed until the tip of the sheet is projected to the outside, the user can easily remove the sheet that remains in the sheet feeding unit or has not reached the sheet feeding unit when the jam occurs.

Note that, after the control unit causes the sheet feeding unit to operate to feed a sheet, the sheet detecting sensor 9 detects whether a tip of the sheet projects from the sheet feeding unit. According to a result of the detection, the control unit judges whether the tip of the sheet projects from the sheet feeding unit or the sheet is still inside the sheet feeding unit. Then, based on a result of the judgment by the control unit, the display unit displays different screens for the user.

Figure 12:
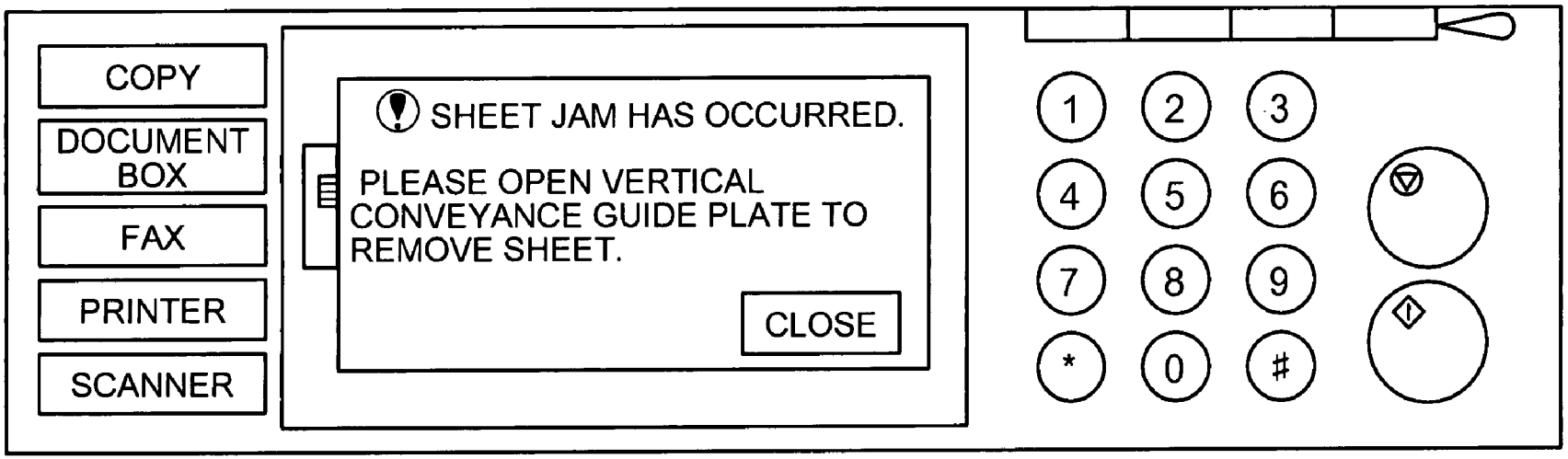
FIG. 12 is a schematic diagram of a screen of a display unit that indicates that a jam has occurred and the vertical conveyance guide plate is to be opened.

First, after the control unit causes the sheet feeding unit to operate to feed a sheet for the predetermined time t, when the sheet detecting sensor 9 detects the leading end of the sheet, the display unit displays that a jam has occurred and the vertical conveyance guide plate 8 is to be opened. FIG. 12 is a schematic diagram of a screen of a display unit that indicates that a jam has occurred and the vertical conveyance guide plate 8 is to be opened. When this screen is displayed, the sheet feeding tray is locked by the tray lock mechanism. Consequently, it is possible to prevent the user from drawing out the sheet feeding tray after recognizing the occurrence of the jam.

Note that, when this screen is displayed, the sheet feeding operation inside the sheet feeding unit has already ended. Then, when the user refers to this screen, recognizes that the jam has occurred, and opens the vertical conveyance guide plate 8, the tip of the sheet has already projected. Therefore, the user is prevented from opening the vertical conveyance guide plate 8 during the sheet feeding operation that is performed after the jam occurs.

Figure 13:
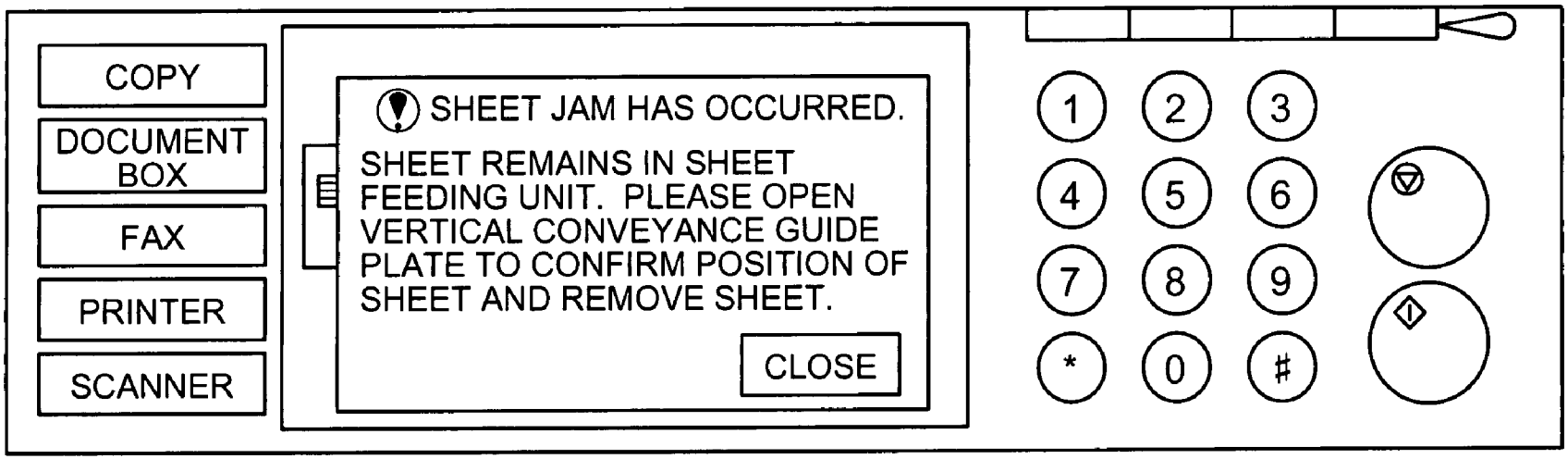
FIG. 13 is a schematic diagram of a screen of the display unit that indicates that a jam has occurred and a sheet still remains inside the sheet feeding unit.

Even after the control unit causes the sheet feeding unit to operate to feed a sheet for the predetermined time t, when the sheet detecting sensor 9 cannot detect the tip of the sheet, the display unit further displays that the sheet remains inside the sheet feeding unit to call the user's attention. FIG. 13 is a schematic diagram of a screen of the display unit that indicates that a jam has occurred and a sheet still remains inside the sheet feeding unit. Since this screen is displayed, the user can recognize the jam has occurred and the sheet remains inside the sheet feeding unit or has not reached the sheet feeding unit. In other words, since a position of the sheet is recognized as the inside of the sheet feeding unit, the user can remove the sheet promptly.

Depending on a state of a jam, a tip of a sheet cannot be projected from the sheet feeding unit in some cases even after the sheet feeding operation is performed. Thus, the user may have to pull out the sheet, which is caught between the sheet feeding tray and the path L, by force. Then, if the sheet is torn by being pulled out by force, the user has to remove the sheet such that no piece of the sheet remains in the sheet feeding unit. In this case, it is desirable that the user can draw out the sheet tray on the one hand and can visually recognize the entire vertical conveyance path in the vertical conveyance guide plate 8 to work such that no piece of the sheet remains in the sheet feeding unit on the other.

In such a state, in the image forming apparatus according to this embodiment, the vertical conveyance guide plate 8 is opened at a predetermined angle or more and for a predetermined time or more, whereby the control unit releases the tray lock. Therefore, in a state in which the vertical conveyance guide plate 8 is opened, the user can draw out the sheet feeding tray without the necessity of performing processing like the closing of the vertical conveyance guide plate 8. Consequently, when a sheet remains on the path L inside the sheet feeding unit, after opening the vertical conveyance guide plate 8, the user can visually recognize both the sheet feeding tray side and the vertical conveyance guide plate 8 side simply by drawing the sheet feeding tray and remove the sheet from the both the sides while taking care that no piece of the sheet remains in the sheet feeding unit.

According to the invention, the sheet feeding apparatus has the tray lock mechanism that can prevent pull-out of a sheet tray. The tray lock mechanism is actuated at the time of occurrence of a jam to prevent pull-out of the sheet feeding tray, opening and closing of the opening and closing unit for the conveying path for removal of a jammed sheet, which is provided closed to the sheet feeding unit, is detected, and the tray lock mechanism is released after the opening and closing unit opens.

Consequently, a jam treatment procedure to be performed by a user is limited to a procedure of always visually observing a jammed sheet from the opening and closing unit of the vertical conveyance guide plate and removing the jammed sheet. In this way, the sheet feeding apparatus is constituted to prevent mistakes in the jam treatment. Then, control for counting an opening time of the opening and closing unit is added to this constitution of the sheet feeding apparatus, whereby, when the opening and closing unit is closed within a predetermined time, the sheet feeding unit judges that treatment for the jammed sheet has not been finished and urges the user to perform processing surely without releasing the tray lock mechanism.

The control unit does not control to release the tray lock until the user opens the opening and closing unit. Consequently, it is possible to prevent the user drawing out the sheet feeding tray, when a jam occurs, before opening the opening and closing unit, which leads to tearing a sheet. This also prevents serious damages such as a damage caused by leaving a piece of the sheet torn inside the sheet feeding apparatus.

The control unit does not always release the tray lock when the user simply opens the opening and closing unit. The control unit releases the tray lock only when the opening and closing unit is open for a predetermined time. This prevents the user from closing the opening and closing unit without visually observing the entire vertical conveying path inside the opening and closing unit opened by the user and drawing out the sheet feeding tray or closing the opening and closing unit without visually observing the entire vertical conveying path sufficiently and drawing out the sheet feeding tray. By preventing these acts of the user, the sheet feeding apparatus allows the user to visually recognize the entire vertical conveying path sufficiently to prevent a sheet that has caused a jam from being overlooked.

The opening and closing angle detecting unit that detects an opening and closing angle is provided in the opening and closing unit. When the opening and closing unit is not open at a predetermined angle or more, the control unit judges that a sufficient space for performing a treatment for a jammed sheet is not secured, recognizes that the treatment is not sufficiently performed, and does not control to release the tray lock.

Note that, in this embodiment, the control unit judges that a sufficient space is secured when the opening and closing unit opens at the predetermined angle or more. However, the invention is not limited to the detection of an opening and closing state of the opening and closing unit according to an opening and closing angle. The control unit only has to be capable of detecting whether the opening and closing unit has moved to a position where the user can visually recognize the entire vertical conveyance path inside the opening and closing unit without a blind spot. For example, when the opening and closing unit is structured to be opened by sliding, the control unit may judge whether the opening and closing unit is open to a degree allowing the user to visually recognize the entire vertical conveyance path by calculating a position of the opening and closing unit from a moving distance or the like of the opening and closing unit.

When the opening and closing unit is not open at the predetermined angle or more, that is, when the opening and closing unit has not moved to a position where the user can visually recognize the entire vertical conveyance path without a blind spot, the control unit does not release the tray lock. Consequently, the sheet feeding apparatus urges the user to open the opening and closing unit to a degree allowing the user to visually recognize the entire vertical conveyance path inside the opening and closing unit without a blind spot. In other words, when a jam occurs, the sheet feeding apparatus urges the user to open the opening and closing unit to a degree allowing the user to visually recognize the entire vertical conveyance path sufficiently without a blind spot to release the tray lock. Consequently, the user can visually recognize the entire vertical conveyance path sufficiently, and it is possible to prevent the user from overlooking a sheet.

After a jam occurs, the control unit causes the sheet feeding unit to operate to feed a sheet for a predetermined time before the opening and closing unit is opened to thereby project a sheet, a tip of which is hidden in the sheet feeding unit, to the outside of the sheet feeding unit (a position where the user can visually recognize the entire vertical conveyance path). Consequently, it is possible to prevent the user from overlooking the sheet when the jam occurs.

The display unit displays that a jam has occurred and the opening and closing unit is to be opened. Thus, it is possible to cause the user to recognize a present state and instruct the user to open the opening and closing unit. In addition, when this screen is displayed, since the control unit has already locked the sheet feeding tray with the tray lock mechanism, the sheet feeding apparatus prevents the user from drawing out the sheet feeding tray after recognizing that the jam has occurred. Since the user is prevented from drawing out the sheet feeding tray, it is possible to prevent the sheet from being torn and prevent serious damages such as a damage caused by leaving the sheet or the like inside the sheet feeding unit.

When the display unit displays the screen, since the sheet feeding operation inside the sheet feeding unit has already ended, the user is prevented from opening the opening and closing unit during the sheet feeding operation. In addition, when the user confirms the occurrence of the jam according to the display and opens the opening and closing unit, the sheet feeding operation has ended and the sheet is projected from the sheet feeding unit. Consequently, it is possible to prevent the user from overlooking the sheet, and the user can easily remove a sheet that remains in the sheet feeding unit or has not reached the sheet feeding unit when the jam occurs.

When the sheet detecting sensor does not detect a sheet after the sheet feeding operation by the control unit, the display unit displays an indication that the sheet remains inside the sheet feeding unit. Thus, it is possible to cause the user to recognize that there is the sheet in the sheet feeding unit. In this case, the display unit is equivalent to the notifying unit of the present invention. Consequently, since the user grasps a position of the sheet causing the jam, the user can remove the sheet promptly. Note that means for notifying the user that the sheet remains in the sheet feeding unit or has not reached the sheet feeding unit is not limited to the display by the display unit but may be sound or the like.

After the user opens the opening and closing unit at a predetermined angle or more and a predetermined time elapses, the control unit controls to releases the tray lock. Thus, the user can draw out the sheet feeding tray freely. In a state in which the opening and closing unit or the sheet feeding tray is opened, it may be difficult to remove a sheet or all pieces of the sheet that are caused when the sheet is torn. After opening the opening and closing unit, the user can draw out the sheet feeding tray without closing the opening and closing unit. Thus, a work procedure is simplified and the user can visually recognize both the entire vertical conveyance path inside the opening and closing unit and the inside of the sheet feeding tray and remove the sheet from both the sheet feeding tray side and the vertical conveyance guide plate side simultaneously. Consequently, work for removing the sheet is simplified and work efficiency is improved. When it is necessary to draw out the sheet feeding tray, since it is unnecessary to close the opening and closing unit, the user can always visually recognize the entire vertical conveyance path inside the opening and closing unit. This makes it possible to prevent pieces of the sheet from remaining inside the sheet feeding unit to cause serious damages.

According to the present invention, it is possible to prevent serious damages. It is also possible to visually recognize every part of the conveying path in the opening and closing unit and the inside of the sheet feeding tray.

Moreover, according to the present invention, it is possible to urge a user to carry out treatment for the jammed sheet surely.

Furthermore, according to the present invention, it is easy for a user to visually recognize or remove the sheet.

Moreover, according to the present invention, it is possible for a user to recognize that a sheet remains in the sheet feeding device or has not reached the sheet feeding device and to take a measure promptly to remove the sheet.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A sheet feeding apparatus comprising:

a sheet feeding tray that houses sheets;

a sheet feeding device that feeds the sheets from the sheet feeding tray one by one;

a lock mechanism that locks the sheet feeding tray to prevent draw-out of the sheet feeding tray;

an opening and closing unit that is pivotable in an open state and a close state, and that forms a conveyance path of the sheet when in the close state;

a sheet detecting unit that detects whether a sheet is present in the conveyance path;

a state detecting unit that detects whether the opening and closing unit is in the open state or the close state; and a control unit that, when the sheet detecting unit detects a sheet in the conveyance path, controls the lock mechanism to lock the sheet feeding tray, and when the state detecting unit detects that the opening and closing unit is in the open state, controls the lock mechanism to unlock the sheet feeding tray.

2. The sheet feeding apparatus according to claim 1, wherein the control unit controls the lock mechanism to unlock the sheet feeding tray when the state detecting unit detects that the opening and closing unit continues to be in the open state for a predetermined time.

3. The sheet feeding apparatus according to claim 1, further comprising a position detecting unit that detects a position of the opening and closing unit in between the close state and the open state, wherein the control unit controls the lock mechanism to unlock the sheet feeding tray when the position of the opening and closing unit detected by the position detecting unit is a predetermined position.

4. The sheet feeding apparatus according to claim 3, wherein the position detecting unit includes an angle detecting unit that detects an angle of the opening and closing unit with respect to the close state of the opening and closing unit to determine the position of the opening and closing unit.

5. The sheet feeding apparatus according to claim 1, wherein, when the sheet detecting unit detects the sheet in the conveyance path, the control unit controls the sheet feeding device performs sheet feeding for a predetermined time.

6. The sheet feeding apparatus according to claim 1, wherein, when the sheet detecting unit detects the sheet in the conveyance path, the control unit controls the sheet feeding device to perform sheet feeding to convey the sheet to a position at which the sheet is detectable by the sheet detecting unit.

7. The sheet feeding apparatus according to claim 6, further comprising a notifying unit that, when the sheet detecting unit detects the sheet in the conveyance path, after the control unit controls the sheet feeding device to perform sheet feeding, notifies that the sheet remains in the conveyance path.

8. The sheet feeding apparatus according to claim 1, further comprising a display unit that, after the control unit controls the lock mechanism to lock the sheet feeding tray, displays that the sheet remains in the conveyance path.

9. An image forming apparatus comprising a sheet feeding apparatus comprising:

a sheet feeding tray that houses sheets;

a sheet feeding device that feeds the sheets from the sheet feeding tray one by one;

a lock mechanism that locks the sheet feeding tray to prevent draw-out of the sheet feeding tray;

an opening and closing unit that is pivotable in an open state and a close state, and that forms a conveyance path of the sheet when in the close state;

a sheet detecting unit that detects whether a sheet is present in the conveyance path;

a state detecting unit that detects whether the opening and closing unit is in the open state or the close state; and a control unit that, when the sheet detecting unit detects a sheet in the conveyance path, controls the lock mechanism to lock the sheet feeding tray, and when the state detecting unit detects that the opening and closing unit is in the open state, controls the lock mechanism to unlock the sheet feeding tray.

* * * * *